US007062885B1

(12) United States Patent
Dickenson, Jr.

(10) Patent No.: US 7,062,885 B1
(45) Date of Patent: Jun. 20, 2006

(54) FOUNDATION WALL, CONSTRUCTION KIT AND METHOD

(76) Inventor: George H. Dickenson, Jr., 103 Mineral Waters Dr., Lexington, SC (US) 29073

( * ) Notice: Subject to any disclaimer, the term of this patent is extended or adjusted under 35 U.S.C. 154(b) by 74 days.

(21) Appl. No.: 10/374,382

(22) Filed: Feb. 25, 2003

Related U.S. Application Data

(60) Provisional application No. 60/359,674, filed on Feb. 26, 2002.

(51) Int. Cl.
*E02D 29/16* (2006.01)
*E04B 1/68* (2006.01)

(52) U.S. Cl. ..... 52/293.3; 52/295; 52/274; 52/582.1; 52/741.13

(58) Field of Classification Search ..... 52/294–295, 52/293.3, 582.1, 587.1, 292, 293.1, 274, 52/741.4, 741.13; 249/33–34, 40, 44
See application file for complete search history.

(56) References Cited

U.S. PATENT DOCUMENTS

| | | | |
|---|---|---|---|
| 2,124,430 | A | 7/1938 | Phillips |
| 2,295,216 | A | 9/1942 | Joy |
| 2,453,223 | A | 11/1948 | Henerson |
| 3,942,294 | A | 3/1976 | Savell, Jr. |
| 4,073,100 | A | 2/1978 | DiGiovanni, Jr. |
| 4,096,675 | A | 6/1978 | Howard et al. |
| 4,136,499 | A | 1/1979 | Nilsen |
| 4,161,089 | A | 7/1979 | Omansky |
| 4,165,591 | A | 8/1979 | Fitzgibbon |
| 4,222,208 | A | 9/1980 | Ferver |
| 4,281,491 | A | 8/1981 | Schonert |
| 4,282,693 | A | 8/1981 | Merklinger |
| 4,348,843 | A | 9/1982 | Cairns et al. |
| 4,443,992 | A | 4/1984 | Shechter |
| 4,517,781 | A | 5/1985 | LeBlanc |
| 4,539,788 | A | 9/1985 | Buijs |
| 4,573,292 | A | 3/1986 | Kaufman et al. |
| 4,583,333 | A | 4/1986 | Minter |
| 4,689,926 | A | 9/1987 | McDonald |

(Continued)

FOREIGN PATENT DOCUMENTS

JP 030169919 * 7/1991

(Continued)

OTHER PUBLICATIONS http://www.tindallconcrete.com—Tindall Corporation. The associated website pages accompanying this document was printed on Sep. 6, 2001.

(Continued)

*Primary Examiner*—Winnie Yip
(74) *Attorney, Agent, or Firm*—Michael A. Mann, Esq.; Nexsen Pruet, LLC

(57) ABSTRACT

The present invention foundation kit is generally comprised of prefabricated modular components and hardware, which can be used for easily and efficiently constructing a foundation for a moderately sized building such as a house. In another aspect, the present invention kit can be seen as embodying a variety of optional modular components that can be used for constructing steps, landings, and/or decks. In still another aspect the present invention can be seen from the perspective of the methods used in fabricating the components of the kit and for constructing a significant portion of a building from the kit including the kit's associated optional components.

In another embodiment the kit is designed to have prefabricated modular wall panels that could be used in the construction of a building having a concrete slab base or foundation.

9 Claims, 10 Drawing Sheets

U.S. PATENT DOCUMENTS

| | | | | |
|---|---|---|---|---|
| 4,751,803 | A | | 6/1988 | Zimmerman |
| 4,909,001 | A | | 3/1990 | de Los Monteros |
| 4,916,874 | A | * | 4/1990 | McCoy et al. ..... 52/293.2 |
| 4,934,121 | A | | 6/1990 | Zimmerman |
| 5,012,627 | A | | 5/1991 | Lundmark |
| 5,038,541 | A | | 8/1991 | Gibbar, Jr. |
| 5,055,252 | A | | 10/1991 | Zimmerman |
| 5,103,613 | A | | 4/1992 | Kinoshita |
| 5,177,914 | A | | 1/1993 | Hilmer |
| 5,277,013 | A | | 1/1994 | Gilbert |
| 5,311,712 | A | | 5/1994 | Accousti |
| 5,428,926 | A | * | 7/1995 | Melfi ..... 52/71 |
| 5,468,098 | A | | 11/1995 | Babcock |
| 5,511,350 | A | | 4/1996 | Nivens |
| 5,511,761 | A | | 4/1996 | Schultz |
| 5,570,549 | A | | 11/1996 | Lung et al. |
| 5,596,853 | A | | 1/1997 | Blaney et al. |
| 5,634,315 | A | | 6/1997 | Toya |
| 5,735,090 | A | | 4/1998 | Papke |
| 5,761,863 | A | | 6/1998 | Sutt, Jr. et al. |
| 5,771,649 | A | | 6/1998 | Zweig |
| 5,785,419 | A | | 7/1998 | McKelvey |
| 5,799,399 | A | | 9/1998 | Schultz |
| 5,799,462 | A | | 9/1998 | McKinney |
| 6,185,879 | B1 | | 2/2001 | Engwall |
| 6,192,639 | B1 | | 2/2001 | Germain |
| 6,256,960 | B1 | | 7/2001 | Babcock et al. |

FOREIGN PATENT DOCUMENTS

| | | | |
|---|---|---|---|
| JP | 030191116 | * | 8/1991 |
| JP | 05033352 | * | 2/1993 |
| JP | 05086628 | * | 4/1993 |
| JP | 050255939 | * | 10/1993 |
| JP | 050287760 | * | 11/1993 |

OTHER PUBLICATIONS http://www.fema.gov/usr/sctc.htm—FEMA National US&R Response System . The associated website pages accompanying this document was printed on Sep. 6, 2001.

http://www.ou.edu/class/hgruenwald—Architecture Courses 5023/4343. The associated website pages accompanying this document was printed on Sep. 5, 2001.

http://www.pcinews.com/concrete—Publications & Communications Inc. The associated website pages accompanying this document was printed on Sep. 5, 2001.

http://www.superiorwallssystems.com—Superior Walls Systems, LLC. The associated website pages accompanying this document was printed on Sep. 5, 2001.

BOCA Evaluation Services, Inc.—http://www.boca-es.com/pdf/98-09.pd.

* cited by examiner

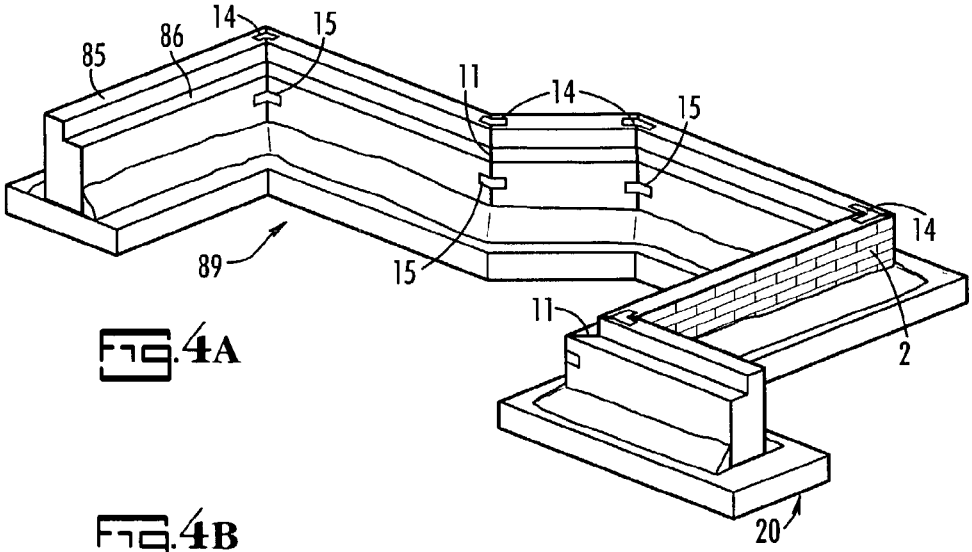
FIG. 4A
FIG. 4B
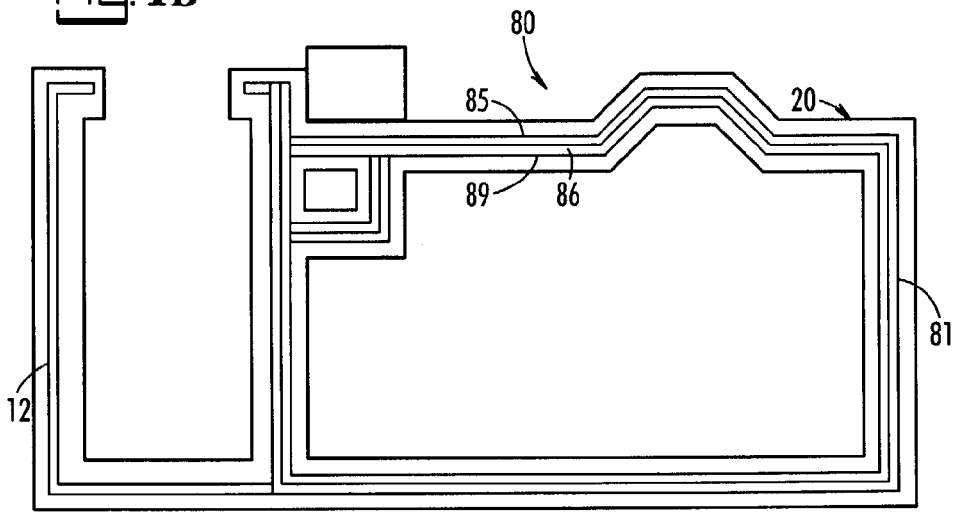
FIG. 4C
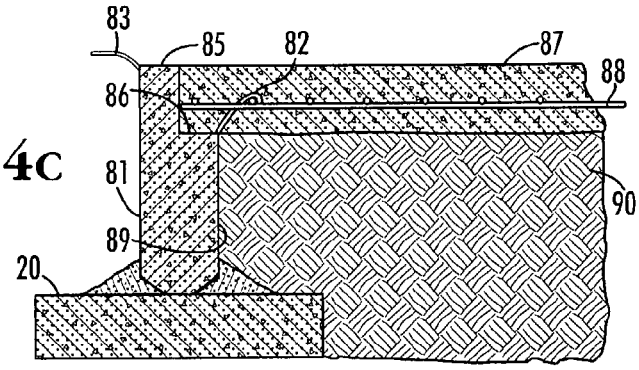

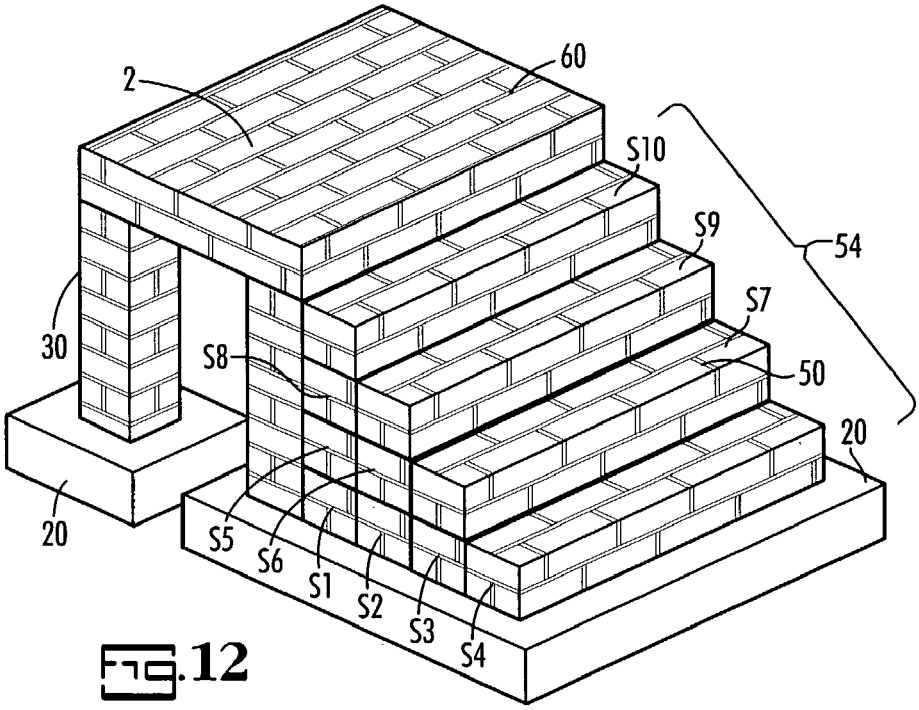
FIG. 12
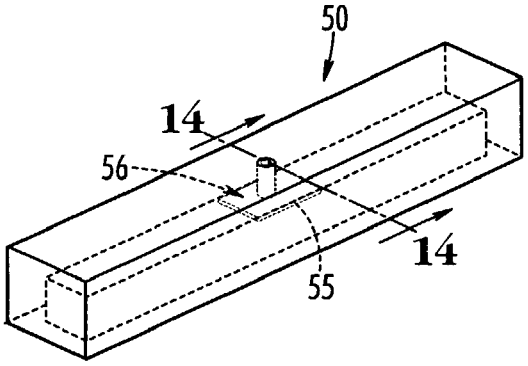
FIG. 13
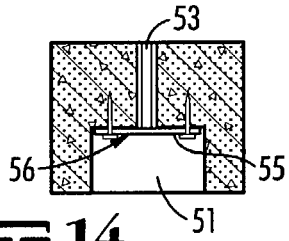
FIG. 14
FIG. 15
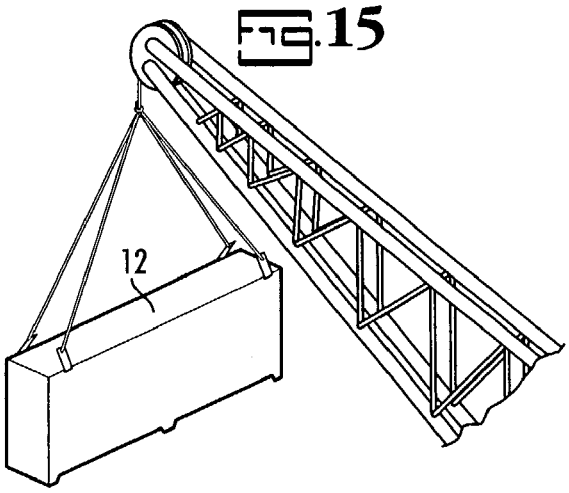

FOUNDATION WALL, CONSTRUCTION KIT AND METHOD

PRIORITY CLAIM

The applicant claims the priority benefit of U.S. provisional patent application Ser. No. 60/359,674, filed Feb. 26, 2002.

FIELD OF THE INVENTION

The present invention relates generally to the construction of buildings and other structures and, more particularly, to the components and methods used for constructing foundations walls, foundation piers, decks, or stairs.

BACKGROUND OF THE INVENTION

A myriad of well known materials, components, and methods are, or can be, used in the construction of a foundation for small to moderately sized residential and commercial structures. Generally, the foundations for buildings of this type are constructed by using standard building methods, and are generally constructed of masonry such as brick, or brick in combination with other masonry, steel, concrete, or any other suitable material or combination of materials. One such standard building method that has evolved over the last few decades is referred to as modular construction. Generally, modular construction is a building technique or method that employs the use of components that are made up of separate, generally pre-made, modular units that can be easily transported, arranged, and joined. The components are generally manufactured at a remote location and then transported to the building site where they are joined together to form the building. Modular construction is an important building technique because its use of pre-manufactured components usually does not require the use of as many skilled workers, such as carpenters for the framing, or brick or concrete masons for the foundation walls. Other reasons why modular construction is important include time savings, and less dependency on the weather. All of which lead, or can lead, to cost savings, which can be significant since a substantial portion of the costs are associated with labor.

Modular construction systems come in a variety of embodiments. An early example is disclosed in U.S. Pat. No. 2,295,216. This patent describes the use of precast, essentially non-stress bearing, components in combination with field cast members, and it also describes the precast units as being made of essentially lightweight porous concrete, which act as an absorption unit tending to allow the aqueous field cast concrete to rapidly and uniformly set. Another example is the prefabricated building and method disclosed in U.S. Pat. No. 4,443,992 to Shechter. This patent describes a modular home that is preferably constructed at an off-site location from pre-cast concrete wall panels. These wall panels are attached to a steel cage through the welding of steel rings, (which are embedded within the concrete panels), to metal rings that are welded to the cage. After the concrete panels are attached and a floor and roof are added to the structure, the building unit is transported to the location where the unit's foundation has been prepared for placement of the unit.

With respect to the foundation of a building, it is used to transfer and spread the weight of a building to the ground upon which the building is constructed. Because of this, a building's foundation may be a building's most important or most critical feature. A foundation is described in U.S. Pat. No. 5,103,613 issued to Kinoshita. This invention is for a foundation for a wooden house that is generally comprised of blocks having grooves, which are designed to receive tenons in order to interlock adjoining foundation blocks. Other foundation patents include U.S. Pat. No. 5,735,090 issued to Papke, and U.S. Pat. No. 5,799,399 issued to Schultz. The Papke patent describes a foundation and a method for forming a foundation that is essentially comprised of attaching extruded modular forms to a track, and then filling the forms with concrete and/or insulating material at the work site. Comparably, the Schultz patent teaches a method for forming monolithic footings and foundation walls at the work site that is essentially comprised of interconnecting prefabricated panels and then filling the interconnected panels with concrete.

Because of the importance of the foundation to the overall structure of a building it would be beneficial if the foundation could be made in a way that allows the foundation to uniformly provide the support that the building needs. At the same time, however, it would be beneficial to home buyers if the costs associated with home building could be reduced, which would allow home buyers the opportunity to get more house for their money. Consequently, it would be particularly useful to be able to fabricate a foundation of consistently high quality that can be readily erected, yet erected with the use of less labor, especially costly skilled labor, and it would be even more useful if such foundations can be incorporated into a foundation kit that could be either designed to be used to construct a particular structure, or custom designed to build an individual home buyer's dream house.

SUMMARY OF THE INVENTION

According to its major aspects and briefly recited, the present invention can be viewed as having several aspects. One such aspect is that it is a foundation wall kit comprised of prefabricated modular components, which are manufactured in a controlled environment in order to produce a consistently uniform product while still having the design flexibility to be able to modify the structural strength characteristics of the components as needed for the particular project. The major components of the kit can be generally characterized as steel-reinforced concrete foundation wall panels, decking and/or landing slabs, steps, and piers including reinforcement piers. These components may include means for facilitating placement, and means for providing both temporary self-support while the kit components are being aligned and/or leveled, and at least a portion of the permanent support after such alignment and/or leveling. To provide this portion of the permanent support, the self-support means will be attached to a footer. In general, and as used herein, a footer is a concrete base that will be used to provide support for the concrete kit components. However, since it may not be a part of the present invention kit, it should be prepared by the builder, or the kit vendor, prior to the delivery of the kit. Additionally, besides using the self-support means to provide permanent support and, therefore, attachment between the kit components and the footer, attachment is accomplished through the use of bonding agents (and, possibly spacers) in the beveled portions on the bottoms of the foundation wall panels and/or other kit components. This beveling is intended to be used to promote the attachment of the kit components, including the foundation wall panels, to the footer through the formation of a bonding agent application space that can be filled with a bonding agent such as mortar, cement, or grout. In some applications, the application space will also be filled with a spacer, which is a formed wedge-shaped component that, along with the bonding agent, will act as a bonding interface between the kit component and the footer. Additionally, some of the kit components will be equipped with integral wall straps for attachment purposes, and/or framing straps, which can be used for attaching standard framing materials such as floor joists to the kit components, and/or will have optional bolting holes formed to enable the bolting together of the kit components. Furthermore, some of the components may be provided with a variety of decorative and/or functional facings including a faux brick or stone, and/or real brick, or any other suitable facing or finishing material. Moreover, in another embodiment, the foundation wall kit will be comprised of foundation wall panels that have been modified to be used for houses that are designed to have slab floors, e.g., poured concrete floors instead of conventional wooden floors.

Another aspect of the present invention kit is its inclusion of structural building options. Included in these options is the availability of modular components for use in building steps, landings and/or decks. Because the optional components may be made by the same controlled prefabrication processes as the standard components previously described, they should be as easy to manufacture, of as high of quality, and should be similar in appearance and texture—making them visually appealing as well. Additionally, many of these optional components will include some, if not all, of the other design features previously described.

Still other aspects of the present invention are the methods used for prefabricating the modular components, which can take into account such crucial concerns as stress loading of the kit's components as well as various cosmetic, i.e., appearance, considerations including color and texture. Relatedly, are the methods used for placing and using the various components of the kit in order to form the foundation walls, piers, decks, and/or stairs of the building being constructed.

A feature of the present invention is that it is prefabricated off-site in a controlled environment, which provides the advantage of not being dependent on the weather. This also provides the user with an opportunity to fabricate more uniformly consistent components, which itself offers the possible benefit of providing uniform stress bearing characteristics.

Another feature of the present invention is that it is preferably made from concrete, which offers the advantages of being less expensive, but stronger than brick.

Another feature of the present invention is that the modular components can be fabricated in a standardized or in a customized manner, which provides the advantages of either controlling the dimensions at the manufacturing facility or allowing the builder to modify the components, as appropriate, at the job site. Related advantages include the ability of controlling the insulative and/or strength characteristics, outward appearances, and other related features of the components. Another advantage associated with the standardized fabrication feature is that the standardized components may be kept at distribution centers located away from the manufacturing facility, which should allow for increased access to the components, and decreased shipping times and costs.

Still another feature of the present invention kit is the use of kit-like building instructions, which can provide the advantage of limiting the skill level and/or the other labor requirements needed to implement the various facets of the present invention.

Other features and their advantages will be apparent to those skilled in the art from a careful reading of the Detailed Description of Preferred Embodiments, accompanied by the drawings.

BRIEF DESCRIPTION OF THE DRAWINGS

In the figures,

FIG. 4A is a perspective view of several slab foundation wall panels installed to footers, according to the embodiment of the present invention shown in FIG. 3A;

FIG. 4B is a top plan view of an example of a completed slab foundation wall, (without showing the framing straps or footing straps), according to the embodiment of the present invention shown in FIG. 3A;

FIG. 4C is a side cross-sectional view of a slab wall panel showing fill material, steel reinforcement, and a concrete slab, according to the embodiment of the present invention shown in FIG. 3A;

FIG. 12 is a perspective view of an example of an optional step feature of the present invention showing a step footer, steps, landing, (or decking), and a foundation pier component being used to hold the landing, (or decking), according to a preferred embodiment of the present invention;

FIG. 13 is a perspective view of one of the optional steps showing the void space and lifting bracket, according to a preferred embodiment of the present invention;

FIG. 14 is a side elevational cut-away view of FIG. 13 taken along lines 14—14;

FIG. 15 is a perspective view of a preferred method of moving and locating a foundation wall panel, according to a preferred embodiment of the present invention;

DETAILED DESCRIPTION OF PREFERRED EMBODIMENTS

Figure 1:
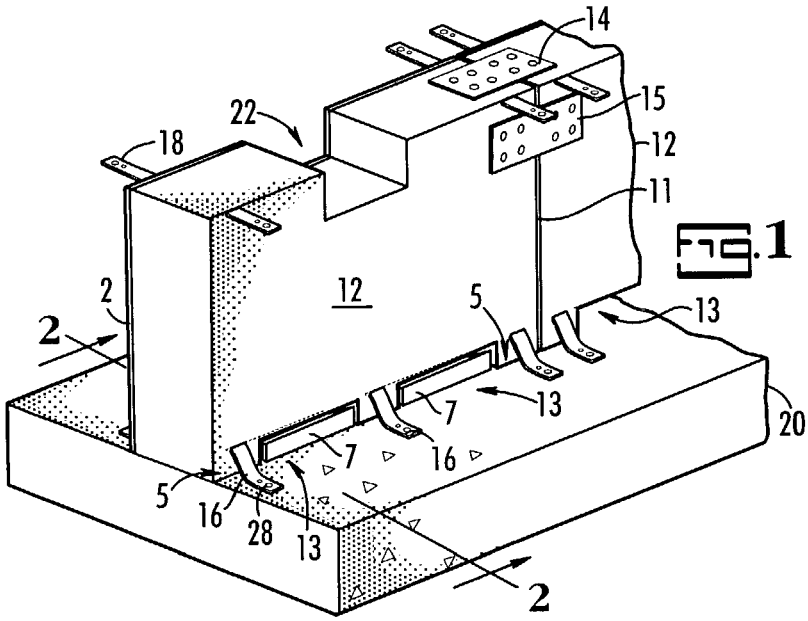
FIG. 1 is a perspective view of foundation wall panel used in the present invention, according to a preferred embodiment of the present invention.

Generally, the present invention can be perceived from several aspects. For one, the present invention is a foundation kit comprising prefabricated modular components and hardware, which may be used for easily and efficiently constructing a foundation for a moderately sized building such as a house. In another aspect, the present invention kit can be seen as embodying a variety of optional modular components that can be used for constructing steps, landings, and/or decks. In still another aspect, the present invention can be seen from the perspective of the methods used in fabricating the components of the kit and for constructing a significant portion of a building from the kit and its associated components.

Preferably, the major components of the present invention kit are fabricated or formed from any standard mixture of concrete; however, any other suitable construction material, i.e., a material that would enable the component of interest to meet its design requirements, can be used for fabricating or forming that component. For example, other suitable construction materials may include non-standard concrete mixtures. Additionally, the major components are preferably homogeneous, in that only a single concrete mixture would be poured into the concrete form or mold; however, any other suitable fabrication or forming process can be used as well. For example, the concrete may be layered with other concrete compositions and/or other suitable construction materials such as insulating foams and/or strengtheners. Therefore, when the term "concrete" is used in association with the kit components herein it is also intended to encompass these other suitable materials and/or fabrication processes. Furthermore, depending on the context in which it is used herein, the singular and plural form of the term "kit component" may refer to the "concrete" components and/or the hardware including the reinforcement and joining plates.

Referring to FIGS. 1A, and 2A–2D, several of the components of the foundation kit 10 are shown including a wall panel 12, structural joining plates 14, and structural reinforcing plates 15. Preferably, the wall panel 12 is a prefabricated modular component made of steel reinforced concrete. The wall panel 12 has footing straps 16 for stabilizing and attaching the wall panel 12 to a footer 20, and framing straps 18 for attaching the framing materials—that may be used in the construction of the building—to the wall panel 12. (Relatedly, foundation piers 30 may also have footing straps 16 and/or framing straps 18, and reinforcement piers 40 may also have footing straps 16 and/or wall straps 17—these other kit components 30 and 40 will be described below). Preferably the footing straps 16, and the framing straps 18 (and the wall straps 17) are made of a flexible, galvanized or corrosion resistant steel, and are connected to the steel reinforcement, if used, in the wall panel 12, and/or the other kit components. Preferably, these straps 16, 17, and 18 are about twelve (12") inches in length, as measured from the outer surface of the wall panel 12 and/or any of the other kit components, about two (2") inches in width, and about one-eighth (0.125") inch in thickness. However, dependent on the expected loading conditions on the kit components and/or on other design considerations, the footing straps 16, the framing straps 18, and/or the wall straps 17, can be fabricated of any other suitable flexible material and/or of any other suitable length, width and/or thickness. Also, as shown in FIGS. 1 and/or 20, the footing straps 16 are located at various points on or near the bottom of the wall panel 12, e.g., the shim points 5, while four framing straps are located at the corners, on or near the top, of the wall panel 12. However, the number of footing straps 16 and/or framing straps 18 used with each wall panel 12 may vary, and the straps 16 and 18 can be located anywhere, as long as the straps 16 and 18 can meet the design requirements of the building and/or the functional requirements of the wall panel 12. For example, the footing straps 16 can be located several inches away from the centerline of the shim points 5; and/or each strap 16 and 18 of a pair of straps 16 or 18 may be longitudinally offset from each other by several inches as well, i.e., a pair of straps would be those two straps 16 or 18 that are located on opposite sides of a wall panel 12 approximately the same distance away from the same longitudinal end of that wall panel 12. (Relatedly, the footing straps 16, the framing straps 18, and/or the wall straps 17, used on the other kit components, i.e., the foundation piers 30 and/or the reinforcement piers 40, may be similarly fabricated and positioned, and the number of straps 16, 17, and/or 18 on a foundation pier 30 and/or a reinforcement pier 40 may be varied as well.) Preferably the wall panels 12 are twelve (12') feet in length, two and one-half (2.5') feet in height, and at least three (3") inches in width. The wall panels 12, however, in line with the building's design requirements, including expected loading, and/or other construction considerations including appearance, may be fabricated in other suitable heights, lengths and widths. For example, design considerations, including the possibility of having a terraced lot, may require the wall panels 12 to be cut in several different heights in order to horizontally align the upper horizontal surfaces of all of the wall panels 12.

Preferably the wall panels 12 (and the other kit components) are prefabricated according to the dimensional requirements of the building at an off-site manufacturing facility. In other words, the lengths, the angles used for the edges, and any openings—such as foundation vent openings 22—of the kit components would be pre-cut at an off-site facility. The cutting of the kit components could be accomplished through the use of ordinary concrete cutting means such as a diamond tooth wet saw, for example, and through the use of standard concrete cutting methods. The cutting of the wall panels 12 (and/or the other kit components), however, can also be accomplished at the job site, if necessary, by using the same or similar ordinary concrete cutting means and methods as well. Also shown in these figures are a joining plate 14 and a reinforcing plate 15. Preferably the joining plate 14 is used for joining, and/or for providing structural support to, adjoining wall panels 12 and the reinforcing plate 15 is used for providing structural support to, and/or for joining, adjoining wall panels 12 and, therefore, for the wall 1 itself. The plates 14 and 15 can be fabricated in various shapes, angles, and/or sizes, and would be preferably made of metal; however, dependent on structural requirements, other suitable materials also may be used.

Figure 21:
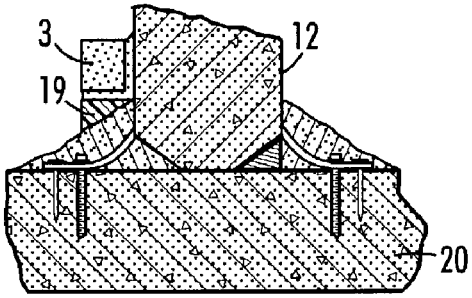
FIG. 21 is a outer side perspective view of the foundation wall panel that has been secured to a footer through the use of its footing straps, and showing the use of a brick laying ledge along with standard brick work on the outer side of the foundation wall panel, according to another preferred embodiment of the present invention.

Additionally, and preferably, the wall panels 12 may include a variety of appearance enhancing features. As examples, the wall panels 12, and/or the other kit components, may be made of colored concrete, or may include any of a variety of textured or non-textured facings, which may give the wall panels 12, and/or the other kit components, the appearance of being made of such materials as stucco, brick 2, stone, or wood. Preferably, appearance based features, such as the use of a colored concrete, a surface material, or a facing, can be incorporated into or onto a wall panel 12, and/or any of the other kit components, during the molding process used to form the wall panels 12, and/or the other kit components. However, features such as a facing may be applied later, e.g., after the concrete in the wall panel 12, and/or the other kit components, has cured, which would make it possible to install the facing at a job site as well as at the factory. Relatedly, real brick 3, other masonry, and/or any other finishing product may also be used. For example, as shown in FIG. 21, a facing ledge 19 can be installed over the bonding agent and then real brick work 3 can be layed upon the facing ledge 19. Other finishing products can be similarly installed.

Preferably, a design plan (Plan) will be prepared by an appropriately licensed professional for the building to be constructed. Preferably, the Plan would be created by factoring in such items as the building's architectural design, pertinent building code requirements, expected stress loadings of the wall 1, and appearance, and it may include such items as the dimensions and locations for the various kit components to be used in the construction of the building. Once the Plan has been completed and preferably approved by the appropriate authorities, the various kit components could be manufactured according to that Plan, e.g., the kit components could be molded for size and cut to the appropriate lengths, have edges cut to appropriate angles, have the appropriate hardware made available, and have openings such as vent openings cut to fit the specifications of the Plan. Furthermore, each wall panel 12 and/or other kit component could be labeled to conform to the identification phraseology, e.g., numbering, indicated on the Plan for each such component. The kit would then be packed and transported to the job site, and, by simply following the Plan's instructions and identification system, the user would be able to efficiently install the kit and, therefore, erect the building at such site.

Figure 5:
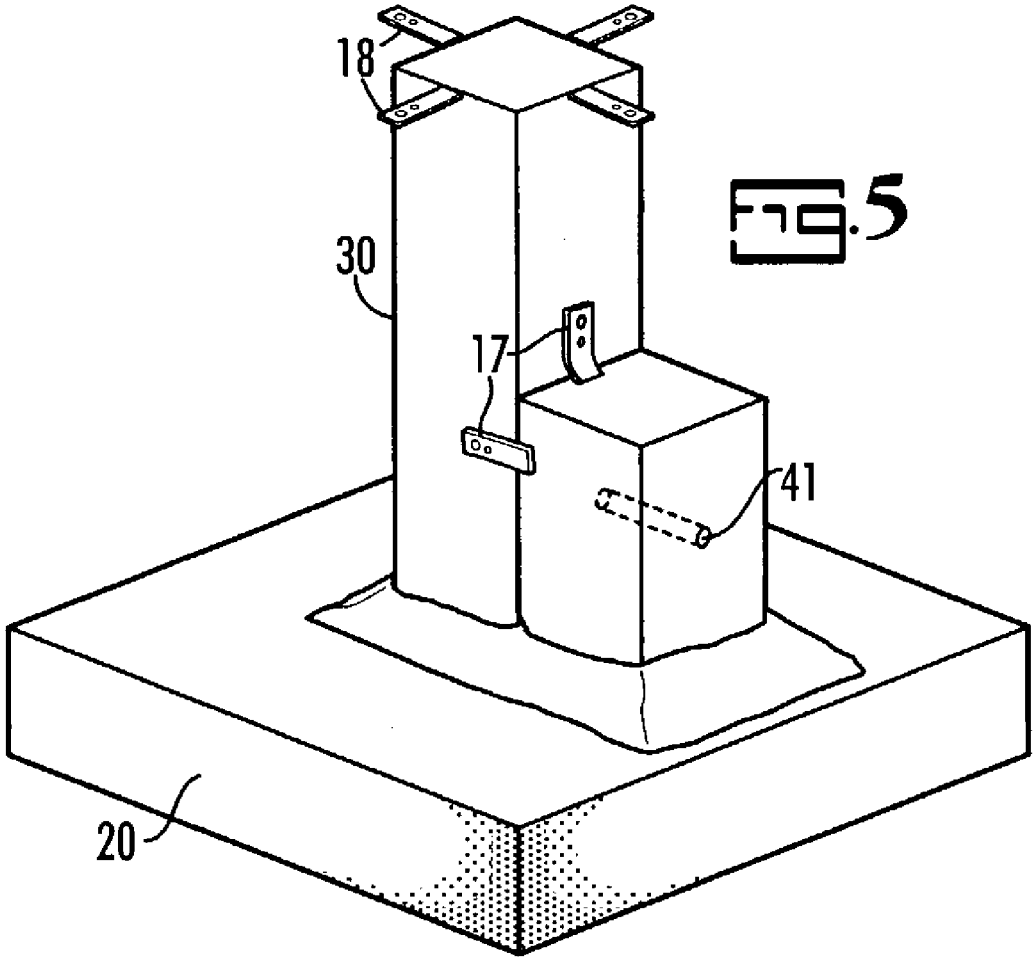
FIG. 5 is a perspective view of a foundation pier and a reinforcement pier (with an optional bolt hole), according to a preferred embodiment of the present invention.
Figure 6:
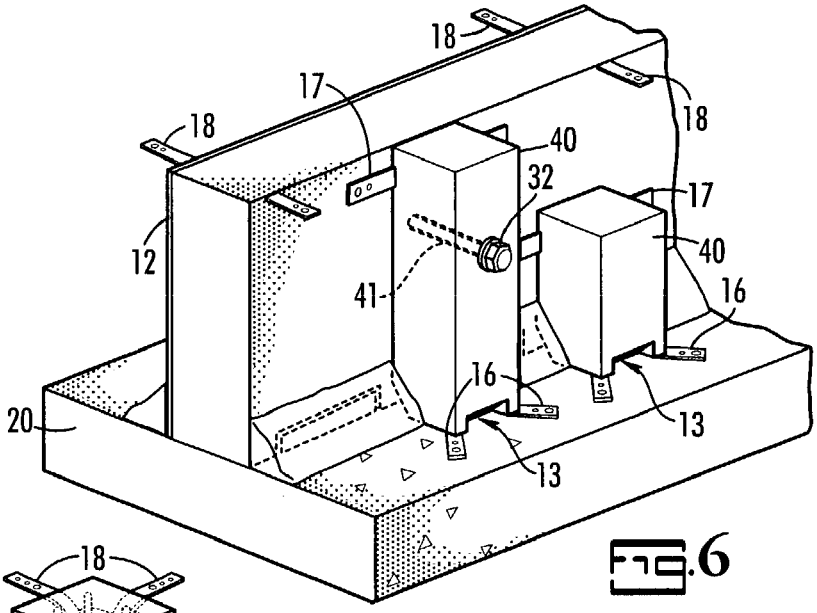
FIG. 6 is perspective view of an installed foundation wall panel and two different sized reinforcement piers (both with an optional bolt hole and one having a bolt installed), according to a preferred embodiment of the present invention.
Figure 10:
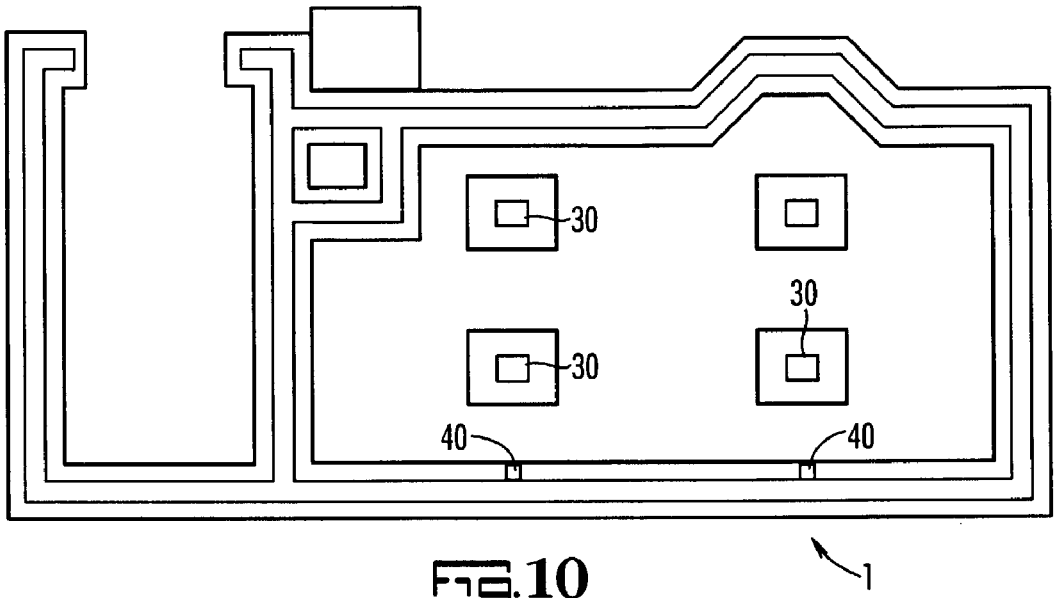
FIG. 10 is a top plan view of an example of a completed foundation wall, (without showing the framing straps or footing straps), and shows a footer for carrying optional modular steps, according to a preferred embodiment of the present invention.
Figure 11:
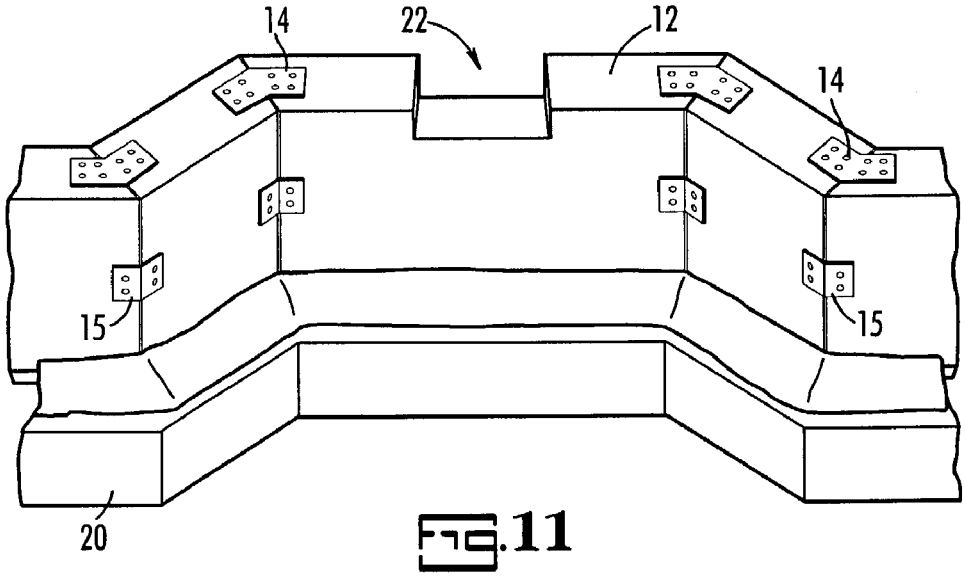
FIG. 11 is a perspective view of a section of installed foundation wall panels showing modular miter cut, (or angle cut), panels, according to a preferred embodiment of the present invention.
Figure 19:
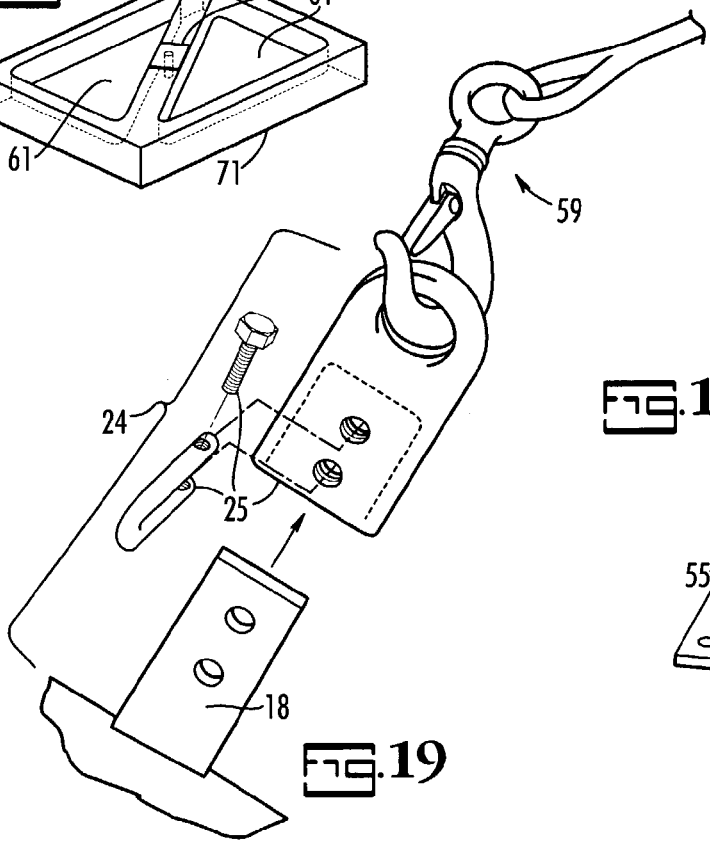
FIG. 19 is an exploded perspective view of the moving and locating bracket assembly, according to a preferred embodiment of the present invention.

Once at the job site, (which should already have a level footer 20 in place, for carrying the wall panels 12 and the various other kit components such as the foundation piers 30, the reinforcement piers 40, the steps 50, and/or a deck 70), the kit's components would be moved and located through the use of lifting bracket assemblies 24 and 52, as shown in FIGS. 13 through 19. With respect to moving and locating the wall panels 12, (and/or the piers 30 and 40), the cabling and/or straps of a mobile crane, or other suitable lifting device, would be attached to the framing straps 18 of a wall panel 12 and/or a pier 30, or the wall straps 17 of a reinforcement pier 40, through the use of a lifting bracket assembly 24, which would be attached to the framing straps 18 as shown in FIGS. 15 and 19 or to the wall straps of a reinforcement pier 40 (not shown). Referring to FIGS. 1–2D, and 6, after a wall panel 12 is lifted and located above a footer 20, the wall panel 12 should be slowly lowered until it is aligned with a previously snapped chalk line, or other alignment aid, used by the builder for properly locating the wall panel 12 on the footer 20. Preferably, the placement of the various kit components is facilitated through the use of the Plan's instructions (and/or the use of markings indicated on the Plan and correspondingly affixed to the kit's components). After a wall panel 12, (and/or a pier 30 or 40), is set into place on the footer 20, the wall panel 12 (and/or the pier 30 or 40) would be temporarily supported through the use of footing straps 16. Preferably, this temporary support is provided by using a concrete nail gun and shooting at least one hardened steel concrete nail 31, which is at least about one (1") inch in length, through the distal opening 28 on at least one of the footing straps 16 and into the footer 20. After ensuring that the wall panel 12, (and/or the pier 30 or 40), is temporarily supported, the wall panel 12, (and/or the pier 30 or 40), is checked to determine if it is level and plumb, and, if it is not level and plumb, the wall panel 12, (and/or the pier 30 or 40), is preferably leveled and plumbed by shimming. Preferably, the shimming is accomplished through the use of standard building construction methods using corrosion resistant metal shims 26; however, any other suitable material can be used to fabricate the shims 26. Then, if necessary, joining plates 14 (and/or reinforcing plates 15) are attached to the wall panels 12, as shown in FIGS. 1 and 11, by inserting hardened steel concrete nails or any other suitable fastening device through the openings formed through the plates 14 (and 15) and into the wall panels 12. After the first wall panel 12, (and/or the pier 30 or 40), is leveled and plumbed, the moving, locating, supporting, and joining procedure is repeated for the adjoining wall panel 12, and for each other wall panel 12 (and/or the pier 30 or 40), until the entire wall 1 is in place. Once this is completed, the wall panels 12 (and/or the piers 30 or 40) will be permanently attached to the footer 20, (and/or to other components, e.g., to a wall panel 12 or a foundation pier 30). To partially accomplish this attachment joining plates 14 (and/or reinforcing plates 15) are attached to the wall panels 12, as shown in FIGS. 1 and 11, by inserting hardened steel concrete nails or any other suitable fastening device through the openings formed through the plates 14 (and 15) and into the wall panels 12, (preferably by using one of the bolt attachment procedures described below), and a high strength corrosion resistant steel bolt 32 is either inserted through the proximal opening 27 on each footing strap 16, (and/or each wall strap 17 and/or through the optional bolt hole 41) and then bolted into the footer 20, (and/or the wall panel 12 or foundation pier 30), or the bolt is inserted through the proximal opening 27 (and/or through the optional bolt hole 41) and bonded to the footer 20, (and/or the wall panel 12 or foundation pier 30). If the bolt 32 is bonded to the footer 20, (and/or the wall panel 12 or foundation pier 30), this can be accomplished by: drilling a hole, which is about the same size in diameter as the bolt 32, into the footer 20, (and/or the wall panel 12 or foundation pier 30); blowing the debris out of the hole; placing a bonding agent such as an epoxy into the hole; and inserting the bolt 32 into the hole. Afterwards, once the kit components are securely attached by the above described procedures to the footer 20 (and/or the wall panels 12 or the foundation piers 30), the wall panels 12 and/or the piers 30 or 40 can be bonded to the footer 20, (and/or reinforcement piers 40 can be bonded to the wall panels 12 or the foundation pier 30), through the use of a high strength mortar, cement, grout, or any other suitable bonding agent. Preferably, to accomplish this bonding, the bottom of each wall panel 12, (foundation pier 30, and/or reinforcement pier 40), is beveled to provide a bonding agent application space 13, which should facilitate and/or improve permanent attachment of the wall panels 12, the foundation piers 30, and/or the reinforcement piers 40, to the footer 20, and, as appropriate, to each other, during the bonding procedure. (The use of beveling on reinforcement piers 40 also may facilitate their placement, as shown in FIGS. 5 and 6.) Preferably a bond spacer 7 is installed into the bonding agent application space 13. The bond spacer 7 is preferably a pre-fabricated, wedge-shaped component that, along with the bonding agent, will act as a bonding interface and will provide an improved bond between the kit component and the footer 20. Preferably the bond spacer 7 is made of concrete and is dimensioned to fill about fifty-percent or more of the volume of the bonding agent application space 13 when installed; however, the bond spacer 7 can be made of any other material and/or of a dimension that would be suitable for the application in which it is being used. Preferably the bond spacer 7 is installed by first applying a sufficient amount of bonding agent onto the footer 20, in the bonding agent application space, 13 so that the bonding agent will entirely, or almost entirely, surround the bond spacer 7 once it is inserted into the bonding agent application space 13. A good indication that a sufficient amount of bonding agent is being used is that some of the bonding agent will actually be displaced from the bonding agent application space 13 when the bond spacer 7 is fully inserted into the bonding agent application space 13. Additionally, and preferably, the bonding agent being used will also provide a watertight, or an essentially watertight, seal to the locations where such agent is being used. Preferably, once the first wall panel 12 or the wall 1 is bonded into place, the vertical spaces 11 between each wall panel are preferably filled with a grout, caulk, or any other suitable sealing agent that is preferably flexible and/or watertight, and of the same color and/or texture as the wall panels 12. Preferably this procedure is repeated until the foundation wall 1 has been completed, an example of such wall is shown in FIG. 10. Also shown in FIG. 10, is an example of where foundation piers 30 and reinforcement piers 40 may be positioned; however the use and/or positioning of other kit components, e.g., decking or steps, will be described below and are not shown in FIG. 10.

The above description of the installation procedure is the preferred procedure; however, any suitable changes to the above procedure could also be used, including the use of some portion, or all, of the permanent wall panel 12 attachment procedure to each wall panel 12 prior to proceeding to the placement of an adjoining wall panel 12.

Figure 2A:
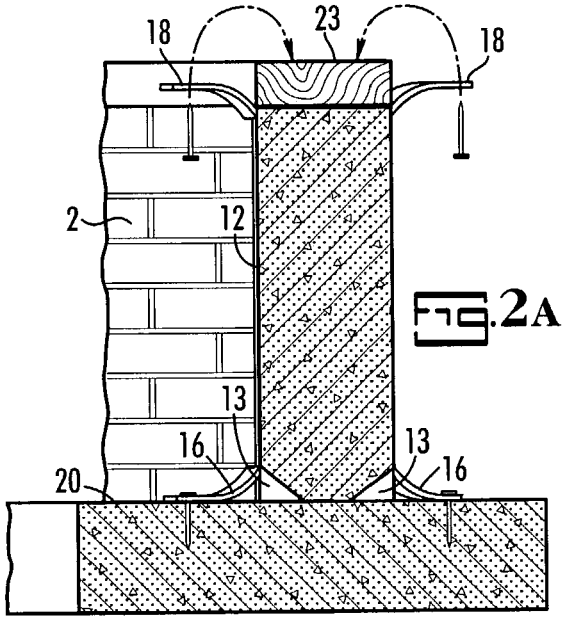
FIG. 2A is a outer side perspective view of the foundation wall panel that has been secured to a footer through the use of its footing straps, and showing the use of a brick facing on the outer side of the foundation wall panel, according to a preferred embodiment of the present invention.
Figure 2B:
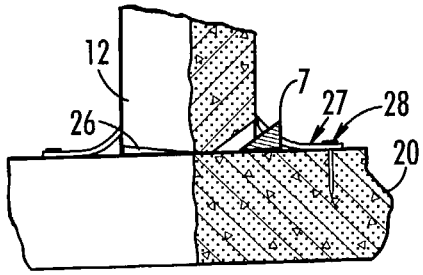
FIG. 2B is a detailed view showing the installation of a leveling shim and a bonding interface, according to a preferred embodiment of the present invention.
Figure 2C:
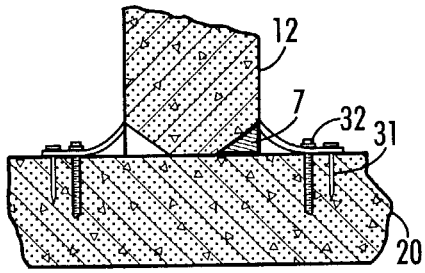
FIG. 2C is a detailed view showing the installation of the bolts, which are used to support the foundation wall panel, according to a preferred embodiment of the present invention.
Figure 2D:
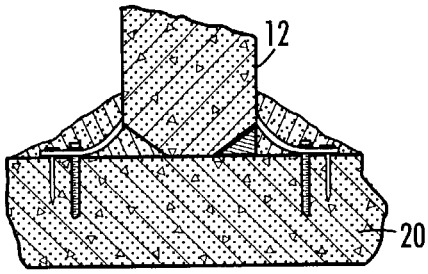
FIG. 2D is a detailed view showing the permanent bonding of the foundation wall to the footer, according to a preferred embodiment of the present invention.
Figure 7:
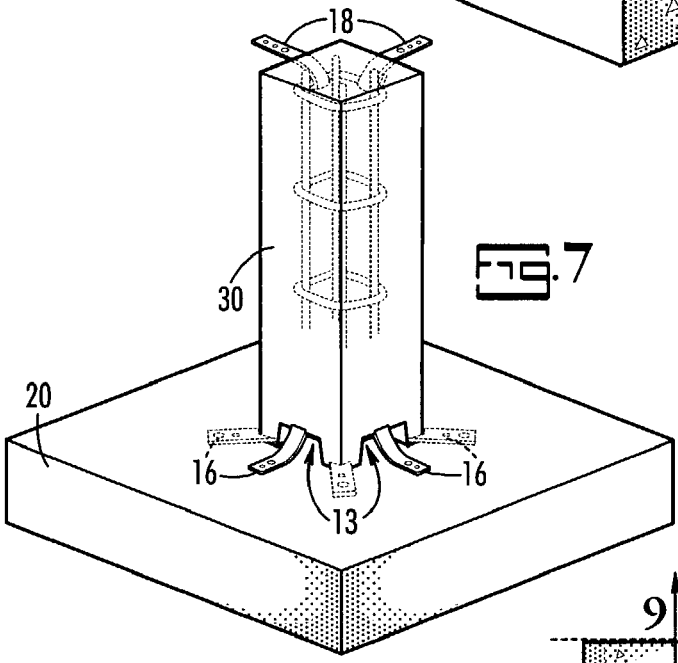
FIG. 7 is a perspective view of the various placement options for the footing and framing straps of the present invention foundation pier as shown in FIG. 5, according to a preferred embodiment of the present invention.
Figure 8:
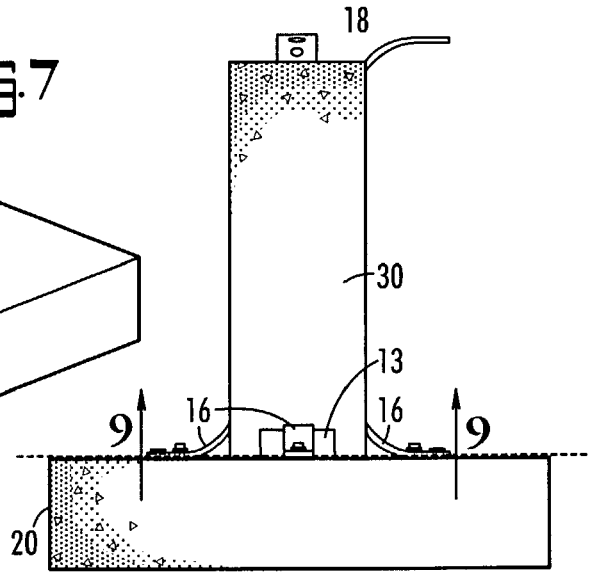
FIG. 8 is a side elevational view of the foundation pier shown in FIG. 7, according to a preferred embodiment of the present invention.
Figure 9:
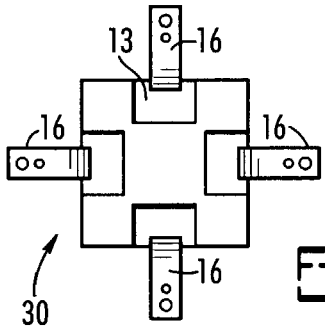
FIG. 9 is a bottom plan view of the pier of FIG. 8, taken along lines 9—9.

As shown in FIG. 2A, the wall panel 12 has a textured facing similar to brick 2 attached to one of its exterior surfaces; however, this facing or any other suitable facing or finishing material including, but not limited to, standard brick work, as shown in FIG. 21, also may be attached to any of its exterior surfaces. Relatedly, any of the other concrete components may have facings or other finishing materials similarly attached to any their exterior surfaces as well, or, as is possible with the wall panel 12, may be fabricated of a colored concrete. Referring to FIGS. 2A, 7 and 8, another feature of the wall panels 12 and the foundation piers 30 is the incorporation of framing straps 18 for securely attaching standard framing material 23, or other kit or non-kit component, to the wall panel 12, (and/or the foundation pier 30). Preferably the framing straps 18 are fabricated and positioned as previously described, and, since the framing straps 18 are preferably flexible, they can be bent so that nails, bolts or other securing devices can be inserted through available openings, which are formed through the framing straps, in order to secure the framing material 23, or other component to the wall panel, (and/or the foundation pier 30).

Shown in FIG. 11 is an example of how the wall panels 12 may be angle cut to correspond to the building's design. As previously mentioned, the building's design is a factor that may be incorporated into the Plan. In which case, the ends (or other portions) of the wall panels 12 may be pre-cut at the manufacturing facility. However, since the wall panels 12 may be cut as required at the job site, the preparation and use of a Plan and/or the pre-cutting are not necessary.

Due to the loading requirements of some projects it may be necessary to provide additional support to the wall panels 12, foundation piers 30, or to other structural components. This support may be provided through the use of reinforcement piers 40, as shown in FIGS. 5 and 6. Reinforcement piers 40 are preferably prefabricated of concrete, which may be steel reinforced, and may have beveled bottoms for facilitating placement and/or for possibly improving their attachment to footers 20. Reinforcement piers 40 also have integral footing straps 16 and/or wall straps 17 for use in securely attaching the reinforcement pier 40 to a wall panel 12, a footer 20, a foundation pier 30 and/or to another kit or non-kit component. Generally, the Plan may prescribe use of a reinforcement pier 40 if, and when, necessary; however, builders that are constructing either Plan or non-Plan buildings may use reinforcement piers 40 whenever they believe such use is required or desirous. Reinforcement piers 40 may be formed through the use of molding processes similar to that used to fabricate the wall panels 12 and/or the other kit components, and the reinforcement piers 40 may be fabricated from a colored concrete and/or may have facings incorporated or otherwise attached onto their exterior surfaces. The reinforcement piers 40, like the wall panels 12, are moved and located for placement through the use of hoisting means such as a mobile crane and at least one lifting assembly 24, which is shown in FIG. 19. The reinforcement piers 40 may be attached to a wall panel 12, a foundation pier 30, a footer 20, and/or to another kit or non-kit component, through the use of the methods previously described for the making of such similar attachments, e.g., the methods used for attaching wall panels 12 to a footer 20. Additionally, a reinforcement pier 40 may have an optional bolt hole 41 for attaching the reinforcement piers 40 to a wall panel 12, a foundation pier 30, or to any other appropriate component.

The bolt hole 41 may be formed during the reinforcement pier 40 fabrication process or it may be drilled through the reinforcement pier 40 after fabrication by using standard concrete drilling tools. Generally, a bolt hole 41 will be centrally located on a reinforcement pier 40; however, design and/or structural loading considerations may require other suitable and/or more appropriate placements.

Another often used kit component is the foundation pier 30, which is generally used to provide support to framing materials as well as to other kit and/or non-kit components, and which is shown in FIGS. 5, 7–9, 12 and 16. Foundation piers 30 are preferably prefabricated of concrete, which may be steel reinforced, and may have beveled bottoms for possibly improving their attachment to a footer 20, as previously described. Foundation piers 30 may have integral footing straps 16 and/or framing straps 18 for use in securely attaching the foundation pier 30 to a footer 20, a landing slab 60, a decking slab 71, and/or to other kit or non-kit component. Generally, the Plan will prescribe the use of a foundation pier 30 if, and when, necessary; however, builders that are constructing either Plan or non-Plan buildings may use a foundation pier 30 whenever they believe such use is required or desirous. The foundation pier 30 may be formed through the use of a molding process similar to the molding processes used to fabricate the wall panels 12 and/or the other kit components, and the foundation pier 30 may be fabricated from a colored concrete and/or may have facings and/or finishing materials incorporated or otherwise attached onto their exterior surfaces. The foundation piers 30, like the wall panels 12, are moved and located for placement through the use of a hoisting means such as a mobile crane and at least one lifting assembly 24, which is shown in FIG. 19, and the foundation piers 30 may be attached to a footer 20, a landing slab 60, a decking slab 71, and/or to another kit or non-kit component, through the use of the methods previously described for the making of such similar attachments, e.g., the methods used for attaching wall panels 12 to a footer 20 and/or to framing materials 23.

Figure 16:
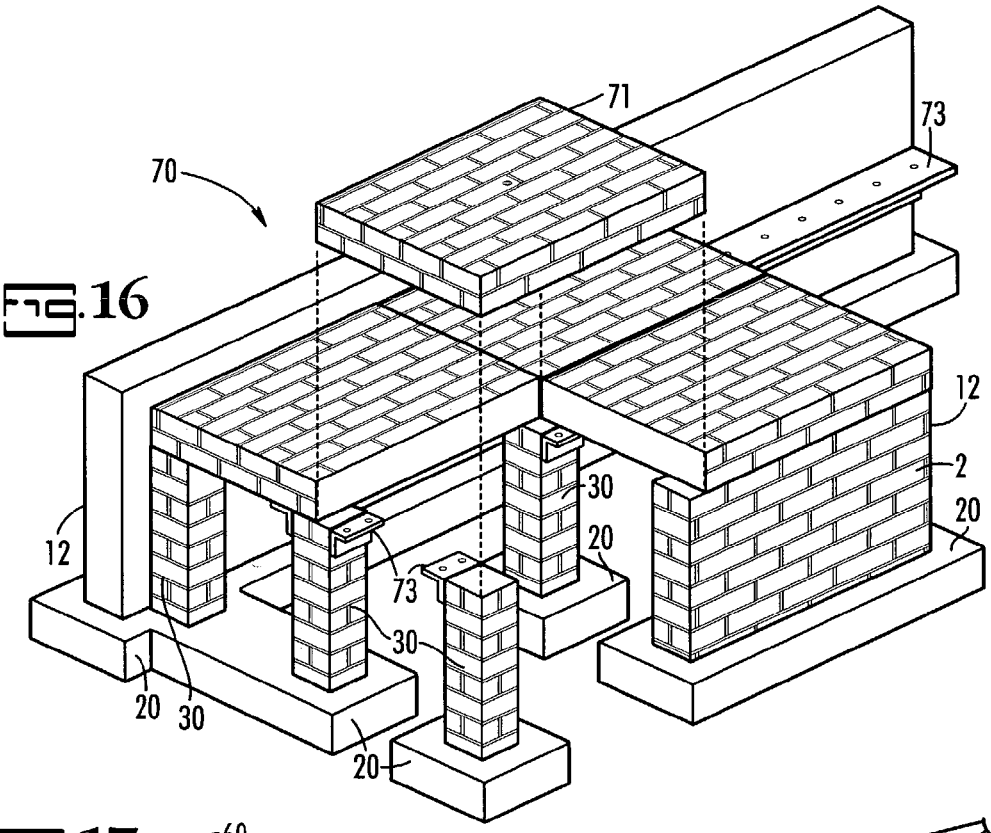
FIG. 16 is an exploded perspective view of an optional deck that can be made with the present invention kit, according to a preferred embodiment of the present invention.
Figure 17:
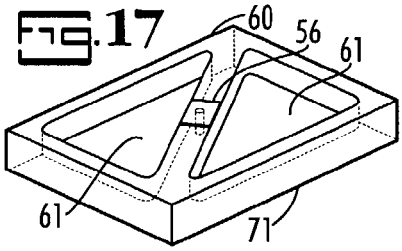
FIG. 17 is a bottom perspective view of one of the deck slabs.
Figure 18:
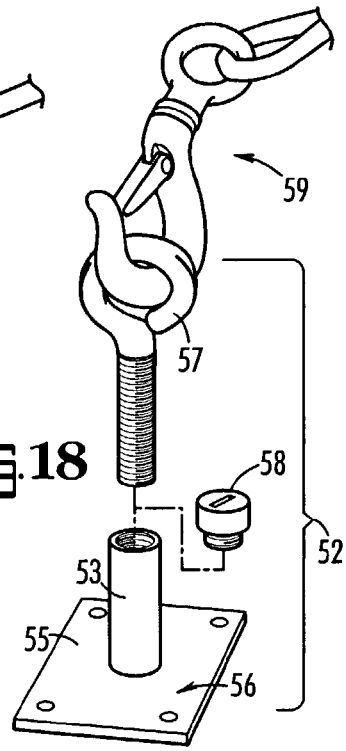
FIG. 18 is an exploded perspective view of the lifting bracket assembly, according to a preferred embodiment of the present invention.
Figure 20:
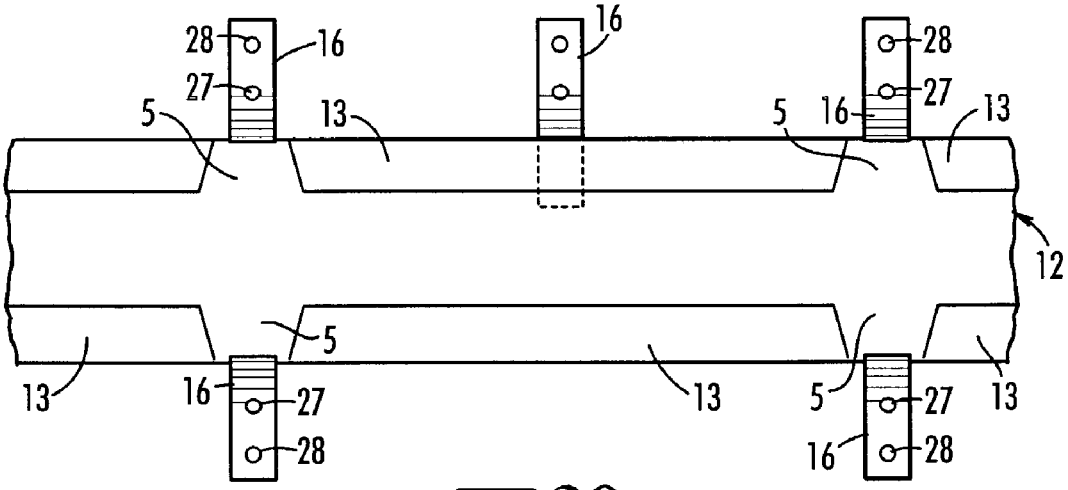
FIG. 20 is a bottom view of a wall panel, according to a preferred embodiment of the present invention.

Other optional kit components are shown in FIGS. 12–14, 16 and 17. These figures show individual steps 50, a set of steps 54, and a landing slab 60. As shown in FIGS. 13, 14, and 18, a step 50 is preferably a prefabricated molded concrete block having at least one void space 51 formed on its bottom side to lessen the weight of the step 50, and having an attached metallic lifting bracket base 56, to which a lifting bolt 57 is connected, for lifting and positioning the step 50. The lifting bracket base 56, the lifting bolt 57, and a plug 58 are the components of the step's lifting bracket assembly 52. The lifting bracket base 56 can either be incorporated into the step 50 by embedding the base 56 into the step 50 during the molding process used to form the step 50, or it can be added to the step 50 after the concrete used to fabricate the step 50 has cured. In which case, the base 56 can be installed by: drilling an opening through the concrete, at the midpoint of the step's top surface's longitudinal centerline, by using a suitable concrete drilling tool; inserting the threaded protuberance 53 of the lifting bracket base 56 from the void space 51 side of the step 50 through the drilled opening so that the flange portion 55 of the lifting bracket base 56 can be attached to the concrete surface immediately above the void space 51; and attaching the flange portion 55 to the concrete through the use of concrete nails or other suitable fastening devices. The plug 58 may be fabricated of metal or plastic, and may be threaded or press-fit into the open end of the threaded protuberance 53. The plug 58, when inserted into the threaded protuberance 53, is used to prevent concrete and/or other debris from entering the threaded protuberance 53. Preferably, the steps 50 are about seven and one-half (7.5") inches in height, about ten (10") inches in width, and about three to seven (3'–7') feet in length; however, dependent on building code requirements and/or other design considerations, any other dimensions can be used. A related kit component is the landing slab 60, which is shown in FIGS. 12 and 17, and which is oftentimes used to complete a set of steps 54. The landing slab 60, like the step 50, is another modular kit component that may have at least one void space 61 formed on its bottom side and may have an attached lifting bracket base 56, which may be attached using any of the procedures described above. Also, both the void space 61 and/or the lifting bracket base 56 are used for the same purposes described above. Preferably, the landing slab 60 is about seven and one-half (7.5") inches in height, about three (3') feet in width, and about three (3') feet in length; however, dependent on building code requirements and/or other design considerations, any other dimensions can be used. Preferably, with reference to the example shown in FIG. 12, a set of steps 54 and a landing slab 60 are installed by: installing level footers 20; attaching a wall panel 12 and/or at least one foundation pier 30 to the footers 20, if necessary, (e.g., in some applications the landing slab 60 and/or steps 50 may be positioned directly upon a footer 20); positioning the first step on, and attaching it to the other kit or non-kit components including the wall panel 12 and/or the footer 20—preferably this first step will be the step referenced as S1 in FIG. 12; positioning and attaching the remaining steps in the following order: S2, S3, S4, . . . , S10; and positioning and attaching a landing slab 60 to the other kit and/or non-kit components, as required. Preferably the steps 50 and/or the landing slab 60 are attached to the kit and non-kit components through the use of a bonding agent and the joints between the components including the steps 50 and/or the landing slab 60 are filled with a grout, caulk, or any other suitable sealing agent that is preferably flexible and/or watertight, and of the same color and/or texture as the wall panels 12. Preferably, additional strength and/or support can be provided to the kit and/or non-kit components including the steps 50 and/or the landing slab 60 through the use of steel straps and/or other bracing and/or fastening devices commonly used in the construction trade. With reference to FIG. 18, the positioning of the steps 50 and/or the landing slab 60 may be accomplished by: removing the plug 58 from the threaded protuberance 53; threadably inserting the lifting bolt 57 into the threaded protuberance 53 until the lifting bolt's 57 threads are fully inserted; attaching a hook and cable assembly 59, which should be attached to a mobile crane or other suitable hoisting device, to the lifting bolt 57; lifting, lowering, and properly positioning the step 50 and/or landing slab 60; removing the lifting bolt 57 and either filling the threaded protuberance 53 with a grout, caulk, or any other suitable sealing agent that is preferably flexible and/or watertight, and of the same color and/or texture as the wall panels 12, or reinstalling the plug 58 and covering it with a grout (or etc.), and then smoothing such grout (or etc.) into the surface of the component. A user of the kit will discover that the use of the lifting bracket assembly 52 with the steps 50 and/or the landing slab 60 will provide a safe and efficient means to quickly position the steps 50 and/or landing slab 60.

Another optional structure that can be constructed using the kit is a deck 70, an example of which is shown in FIG. 16. The main component of a deck 70, which has not been previously described, is a decking slab 71, which is structurally similar to the previously described landing slab 60 but is generally of larger dimensions. Preferably, the decking slab 71 is about seven and one-half (7.5") inches in height, and about six (6') feet in width, and about six (6') feet in length; however, dependent on building code requirements and/or other design considerations, any other dimensions can be used. Therefore, FIG. 17 shows an embodiment of a landing slab 60, and also shows an embodiment of a decking slab 71 as well. Preferably the decking slab 71 is fabricated, moved, positioned, and attached to the other kit and/or non-kit components in the same, or similar, manner (using the same, or similar, methods) as those previously described for the other kit components. Accordingly, the decking slabs 71 may have at least one void space 61, and attached lifting bracket assemblies 52. FIG. 16 shows an example of a deck 70 project. As shown, a portion of the foundation wall 1 has been constructed, foundation piers 30 and a wall panel 12 have been installed onto footers 20, and several of the decking slabs 71 have been installed to the wall 1 and to these other kit components 12 and/or 30. In some applications it may preferable to use only foundation piers 30 to support the decking slabs 71; however, these are not the only possibilities available for installing a deck and any other suitable installation option could also be used as well. Another preferable method for attaching the decking slabs 71 to the wall 1 and/or the other kit components 12 and/or 30 comprises the use of angle irons 73 to provide support and to facilitate attachment of the decking slabs 71 to the wall 1 and/or the other kit components 12 and/or 30. The angle irons 73 are preferably of standard design and easily obtained through normal construction supply channels, and are bolted to the decking slabs 71, the wall 1, the wall panel 12, and/or the foundation piers 30 by using standard construction methods including the epoxying method previously described. As with the other kit components, it will be possible to modify the dimensions and/or shapes of the deck 70 components, the steps 50, and/or the landing slab 60 as necessary at the job site.

Figure 3A:
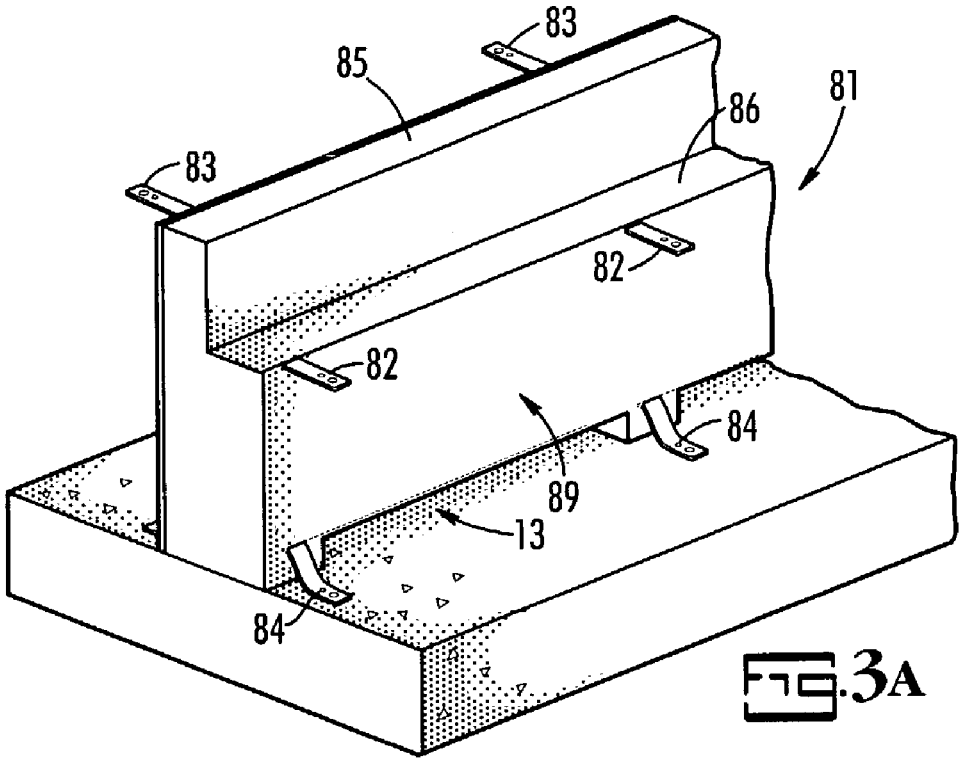
FIG. 3A is a perspective view of a slab foundation wall panel, according to another preferred embodiment of the present invention.
Figure 3B:
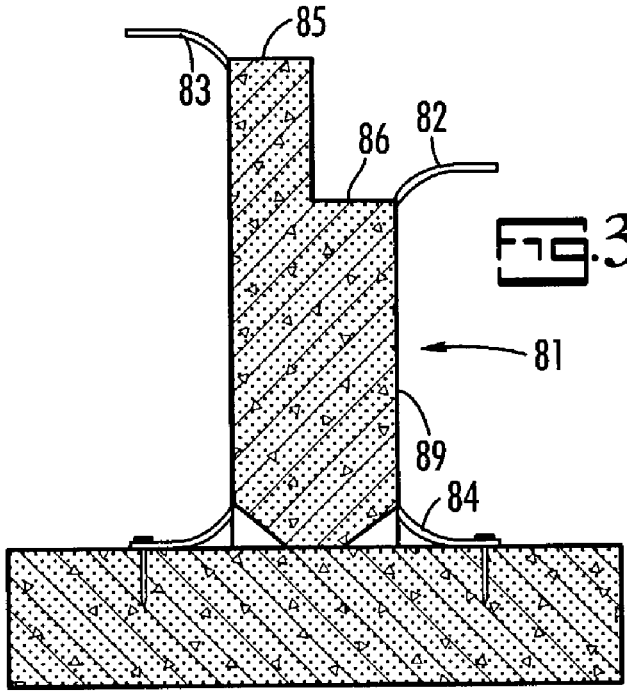
FIG. 3B is an elevational view of a slab foundation wall panel, according to the embodiment shown in FIG. 3A.

Another embodiment of the foundation wall kit is for the construction of buildings having concrete slab foundations, as shown in FIGS. 3A, 3B, and 4A–4C. Generally, all of the previously described features of the wall panel 12, are features of the slab wall panel 81, and most, if not all, of the previously described methods used for fabricating, moving, and attaching the wall panels 12 together to form a wall 1 are the same methods used for fabricating, moving, and attaching the slab wall panels 81 together to form a slab wall. A slab wall panels 81, like the wall panel 12, has footing straps 84 for attaching it to the footer 20; however, there are a few differences. Referring to FIGS. 3A and 3B, the slab wall panel 81 has an upper ledge 85 and a lower ledge 86. The upper ledge 85 is used in the same way as the upper surface of a wall panel 12, and the wall panel 81 has slab straps 82 and framing straps 83 that can be used for moving and positioning the slab wall panel 81 and for attaching standard framing material to the slab wall panel 81. The lower ledge 86, located on the inner side 89 of the slab wall panel 81 is not a feature of the wall panel 12, and instead of just having framing straps 83 the slab wall panel 81 also has slab straps 82 for attaching the slab wall panels 81 to the concrete slab 87 and/or to the steel reinforcement 88 used in the concrete slabs 87. Preferably, the slab straps 82 and/or the framing straps 83, through the use of a lifting bracket assembly 24 and a hoisting means, can be used to move the slab wall panels 81 in a manner similar to that used to move the wall panels 12, (as previously described). An example of a portion of a slab foundation wall 80 is shown in FIGS. 4A. A preferable method of constructing a slab foundation building may comprise the steps of: having a sufficient volume of fill material 90 available to form the base for the concrete slab 87, a significant amount of which may be placed within the expected boundaries of the slab foundation wall 80; completing the entire slab foundation wall 80, an example of which is shown in FIG. 4B; leveling the fill material within the interior of the slab foundation wall 80, and adding additional fill as necessary so that the height of the surface of the fill material 90, after being tamped, is level, or almost level, with the height of the horizontal surface of the bottom ledge 86; adding a steel reinforcement structure 88 on top of the surface of the fill material 90, which will be used as reinforcement for the concrete slab 87, and which should not be higher than the height of the horizontal surface of the upper ledge 85; attaching slab straps 82 to the steel reinforcement; and pouring a sufficient volume of concrete so that the height of the upper surface of the cured concrete slab 87 is level, or almost level, with the height of the horizontal surface of the upper ledge 85. Preferably, prior to placing any material on the interior surface of a slab wall 80 and/or the inner side 89 of a slab wall panel 81, which may cause a stress to be applied to any of these components 80 and/or 81, a sufficient amount of temporary bracing should be used to apply a counter force to the outer side of these components 80 and/or 81.

As previously described, and preferably, the slab wall panels 81, like the other kit components, may include a variety of appearance enhancing features that are incorporated into the slab wall panels 81. Furthermore, the slab wall panels 81 may also be cut at the job site for lengths, angles, and openings, but, like the other kit components, it would be preferable if the slab wall panels 81 are prefabricated at the manufacturing facility. Besides using the slab wall straps 82, the framing straps 83, and the footing straps 84, the slab wall panels 81 can be attached to other slab wall panels 81 and/or to the other kit and/or non-kit components through the use of joining plates 14, reinforcing plates 15, and/or steel straps as needed. Also, as previously described in conjunction with the other kit components, the joints between the slab wall panels 81 can be filled with a grout, caulk, or any other suitable sealing agent that is preferably flexible and/or watertight, and of the same color and/or texture as the slab wall panels 81. Additionally, the bottoms of the slab wall panels 81, like the bottoms of the other kit components 12, 30, and/or 40, are preferably beveled in order to form a bonding agent application space 13.

Figure 22A:
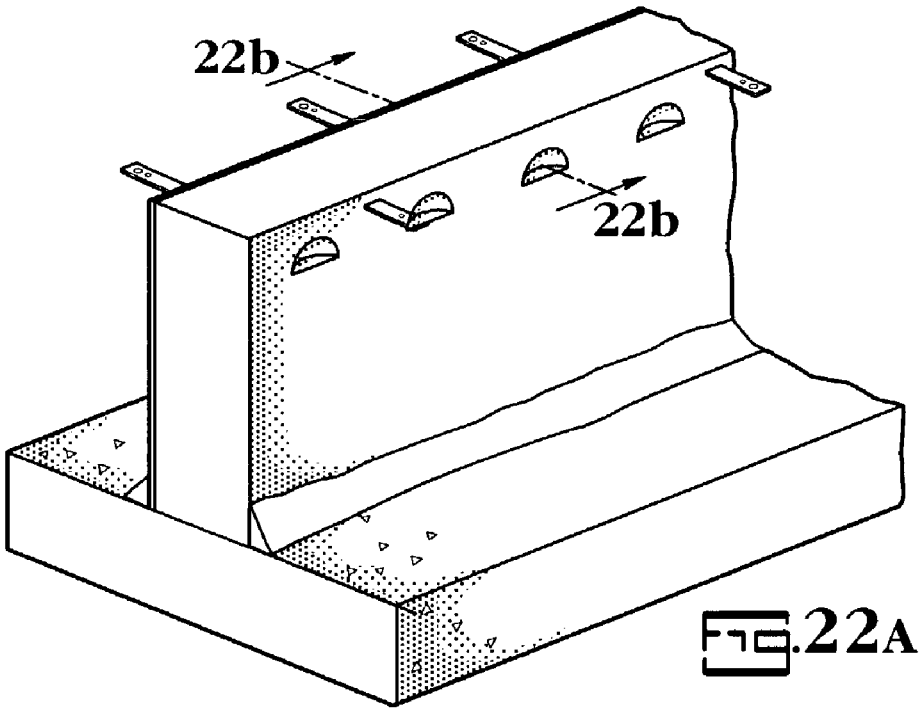
FIGS. 22A and 22B illustrate a slab foundation wall panel that is an alternative preferred embodiment of the present invention to that shown in FIGS. 3A and 3B.
Figure 22B:
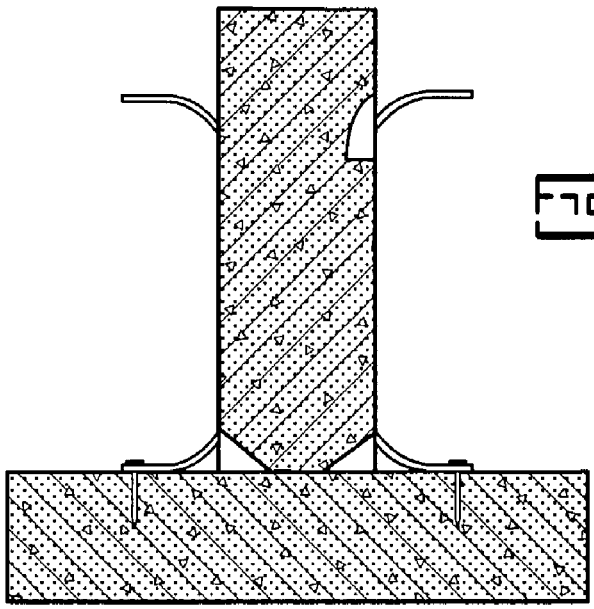

Referring to FIGS. 22A and 22B, there is illustrated an alternative slab wall panel 95 that may also be used as a wall panel for construction other than slab construction. Slab wall panel rests on a footer 96 and is affixed thereto in the same manner as described above for wall panel 12 and slab wall panel 81. In addition, slab wall panel 95 has framing straps 97 for attaching framing (not shown). Instead of lower ledge 86, however, slab wall panel 95 has a series of cut out portions 98 to receive corresponding projections from a slab (not shown) and thereby provide support for the slab when slab construction is used. When slab construction is not preferred, cut out portions may be safely ignored and slab wall panel 95 can be used in the same manner as wall panel 12. Thus, one design can be used to accommodate a house with slab construction, without slab construction and with a mixture of slab and non-slab construction Additionally, in order to facilitate the use of the kit for constructing various non-Plan structures, the dimensions of the kit components can be standardized, stored at local or regional distribution centers, and cut to size at the distribution center or at the job site as needed.

While the invention herein disclosed has been described by means of specific embodiments and possible applications thereof, numerous modifications, and variations could be made thereto by those skilled in the art without departing from the spirit and scope of the present invention. Accordingly, the scope of the invention should be determined not by the embodiments illustrated, but by the appended claims and their legal equivalents.

| LIST OF REFERENCE NUMBERS | |
|---|---|
| the wall | 1 |
| brick | 2 |
| real brick work | 3 |
| shim points | 5 |
| spacer (application space) | 7 |
| foundation kit | 10 |
| vertical space | 11 |
| wall panel | 12 |
| bonding agent application space | 13 |
| joining plates | 14 |
| reinforcing plates | 15 |
| footing straps | 16 |
| wall straps | 17 |
| framing straps | 18 |
| ledge | 19 |
| footer | 20 |
| foundation vent openings | 22 |
| framing material | 23 |
| lifting bracket assembly | 24 |
| lifting brackets | 25 |
| shims | 26 |
| proximal opening | 27 |
| distal opening | 28 |
| foundation piers | 30 |
| nail | 31 |
| steel bolt | 32 |
| reinforcement piers | 40 |
| bolt hole | 41 |
| steps | 50 |
| void space | 51 |
| bracket assembly | 52 |
| threaded protuberance | 53 |
| set of steps | 54 |
| steps | S1, S2, S3, S4, . . . , S10 |
| flange portion | 55 |
| lifting bracket base | 56 |
| lifting bolt | 57 |
| plug | 58 |
| hook and cable assembly | 59 |
| landing slab | 60 |
| void space | 61 |
| deck | 70 |
| decking slab | 71 |
| angle irons | 73 |
| slab wall | 80 |
| slab wall panel | 81 |
| slab straps | 82 |
| framing straps | 83 |
| footing straps | 84 |
| upper ledge | 85 |
| lower ledge | 86 |
| concrete slab | 87 |
| steel reinforcement structure | 88 |
| inner side of the slab wall panel | 89 |
| fill material | 90 |
| slab wall panel | 95 |

-continued

| LIST OF REFERENCE NUMBERS | |
|---|---|
| footer | 96 |
| framing straps | 97 |
| cut out portions | 98 |

What is claimed is:

1. A foundation wall kit, comprising:

plural wall panels, each wall panel of said plural wall panels having a beveled bottom edge;

plural plates adapted for joining said wall panels together;

means for attaching said plural plates to said plural wall panels when said plural wall panels are placed end to end on a footer to define a foundation wall, said plural wall panels thereby being joined together;

plural spacers, each spacer of said plural spacers being dimensioned to be insertable between said beveled bottom edge of said wall panel and said footer, when said wall panel is placed on said footer; and means for bonding said each spacer to said bottom edge of said each wall panel and to said footer when said each wall panel is placed on said footer and said each spacer is inserted between said each wall panel and said footer.

2. The foundation wall kit as recited in claim 1, further comprising plural piers, each pier of said plural piers having a beveled bottom edge and carrying means for attaching said each pier to said footer.

3. The foundation wall kit as recited in claim 1, further comprising:

decorative facing; and means for attaching said decorative facing to said plural wall panels when said plural wall panels placed on said footer.

4. The foundation wall kit as recited in claim 1, further comprising framing straps carried by said plural wall panels, said framing straps being adapted to be attachable to framing.

5. The foundation wall kit as recited in claim 1, wherein said each wall panel of said plural wall panels has an inside face with at least one cut out portion for supporting a foundation slab.

6. The foundation wall kit as recited in claim 1, wherein said each wall panel of said plural wall panels has a brick ledge formed thereon.

7. The foundation wall kit as recited in claim 1, wherein said plural wall panels are made of reinforced concrete.

8. The foundation wall kit as recited in claim 1, further comprising foundation piers for use in spaced relation to said plural wall panels.

9. The foundation wall kit as recited in claim 1, further comprising reinforcement piers for use adjacent to said plural wall panels.

* * * * *